US006485121B1

(12) United States Patent
Müterthies et al.

(10) Patent No.: US 6,485,121 B1
(45) Date of Patent: Nov. 26, 2002

(54) FASTENING ARRANGEMENT

(75) Inventors: Ralf Müterthies, Löhne (DE); Stefan Rüter, Bad Oeynhausen (DE); Carsten Meyer, Bielefeld (DE); Gerhard Schröder, Bad Oeynhausen (DE); Jörg Aufderheide, Spenge (DE)

(73) Assignee: Paul Hettich GmbH & Co., Kirchlengren (DE)

( * ) Notice: Subject to any disclaimer, the term of this patent is extended or adjusted under 35 U.S.C. 154(b) by 54 days.

(21) Appl. No.: 09/663,181

(22) Filed: Sep. 15, 2000

(30) Foreign Application Priority Data

Sep. 17, 1999 (DE) ..... 199 44 643

(51) Int. Cl.[7] ..... A47B 88/00
(52) U.S. Cl. ..... 312/348.1; 348/330.1
(58) Field of Search ..... 312/330.1, 334.1, 312/334.7, 334.8, 334.14, 348.1, 348.2, 348.4

(56) References Cited

U.S. PATENT DOCUMENTS

| | | | | |
|---|---|---|---|---|
| 3,029,357 A | | 4/1962 | Williams | 312/348.1 |
| 3,549,301 A | | 12/1970 | Harris et al. | 312/330.1 |
| 3,729,246 A | | 4/1973 | Harrell et al. | 312/330.1 |
| 5,197,791 A | | 3/1993 | Domenig | 312/348.1 |
| 5,370,454 A | | 12/1994 | Domenig | 312/348.1 |
| 5,433,518 A | | 7/1995 | Skov | 312/348.1 |
| 5,556,183 A | * | 9/1996 | Brustle et al. | 312/348.1 |
| 5,992,958 A | * | 11/1999 | Scheible | 312/348.2 |
| 6,053,592 A | * | 4/2000 | Sutterlutti | 312/330.1 |
| 6,095,627 A | * | 8/2000 | Sutterlutti | 312/348.2 |

FOREIGN PATENT DOCUMENTS

| | | |
|---|---|---|
| DE | G 73 17 344.1 | 5/1973 |
| DE | GM 79 00 396 | 6/1980 |
| DE | G 83 33 251.0 | 3/1984 |
| DE | 40 16 452 A1 | 9/1991 |
| DE | G 93 11 493.1 | 11/1993 |
| DE | G 94 07 813.0 | 9/1994 |
| DE | 19726466 A1 | 12/1998 |

* cited by examiner

*Primary Examiner*—James O. Hansen
(74) *Attorney, Agent, or Firm*—Barnes & Thornburg

(57) ABSTRACT

A fastening arrangement for fastening a drawer or a sliding bottom on a pull-out slide has a first fastening element which can be connected with the sliding bottom, and a second fastening element which can be connected with a rail of the pull-out slide. The first fastening element is pivotally connected to the second fastening element. The fastening arrangement has at least two connection parts which can be mounted separately of one another on a rail of the pull-out slide and which are each provided with at least a first and second fastening element. The first fastening element is preferably each constructed of a pin made of a plastic material which is molded to the connection part.

11 Claims, 4 Drawing Sheets

FASTENING ARRANGEMENT

BACKGROUND AND SUMMARY OF THE INVENTION

The invention relates to a fastening arrangement for drawers, sliding bottoms or other displaceably disposed components which are displaceably disposed by a pull-out slide on a stationary part, such as a furniture body.

Filed contemporaneously herewith are six United States patent applications, commonly assigned to Paul Hettich GmbH & Co.:

| INVENTOR(S) | TITLE | ATTY DOCKET |
|---|---|---|
| Müterthies, Rüter, et al. | Fastening Arrangement | 824/36770 |
| Müterthies, Rüter, et al. | Fastening Arrangement | 824/36771 |
| Müterthies, Rüter, et al. | Mounting Unit | 824/36772 |
| Müterthies, Rüter, et al. | Fastening Arrangement | 824/36773 |
| Müterthies, Rüter, et al. | Pull-out Slide Set | 824/36774 |
| Müterthies, Rüter, et al. | Partitioning System | 824/36775 |

The claims, drawings and specification of each of the foregoing applications is hereby specifically incorporated by reference into this specification as if set forth verbatim herein.

German Patent Document DE 73 17 344 U1 shows a fastening arrangement for pull-out slides wherein a connection piece for the connection with a drawer is provided on a slide rail. The connection piece engages in a V-shaped section at a side wall of the drawer so that the drawer is fixedly connected with the slide rail. This fastening arrangement has the disadvantage that the connection piece and the drawer have to be mutually coordinated with respect to their shapes. In addition, in the preassembled condition, the fastening arrangement with the drawer can be furnished only with considerable space requirements.

German Patent Document DE 197 26 466 A1 shows a fastening arrangement in which the side wall of a drawer can be connected by way of a profile rail with a slide rail of a pull-out slide. The profile rail has a hinge-type construction so that the lateral wall of the drawer can be folded into a position parallel to the drawer bottom. Although this fastening arrangement has the advantage that a drawer element in the preassembled condition requires little space when the side walls extend parallel to the bottom, the profile rail is specifically coordinated with the respective side walls and the bottom and cannot easily be used for drawers of different sizes. Furthermore, for the fastening arrangement, no adaptation can take place to different mechanical stress situations.

It is therefore an object of the invention to provide a fastening arrangement which can flexibly be used for drawers and sliding bottoms of different sizes and constructions and can be adapted to the respective use. In addition, the fastening arrangement is to be produced at reasonable cost.

This object is achieved by a fastening arrangement according to the present invention. If the fastening arrangement has at least two connection parts which can be mounted separately of one another on a rail of a pull-out slide and which are each provided with first and second fastening element for the connection with the rail and a sliding bottom, the length of the sliding bottom as well as the height of the drawer can be selected independently of the fastening arrangement. The fastening arrangement can therefore be used universally for different types of drawers, etc. For example, for high mechanical stress, more than two connection elements can be provided along the rail of the pull-out slide in order to obtain the necessary stability. Despite the module-type design of the fastening arrangements, the fastening arrangement can be stacked in a flat manner in the preassembled condition. The term "sliding bottom" contained in the claim comprises embodiments in which only a bottom is provided as well as embodiments in which, in addition to the bottom, side walls, frames or similar components are provided for forming a drawer.

According to a preferred embodiment of the invention, each connection part has a first supporting surface on which the sliding bottom is partially supported, and a second supporting surface is provided which rests on a rail of the pull-out slide. This arrangement is particularly stable and provides a good force reduction. In this case, the connection part may have an approximately Z-shaped section, the supporting surfaces being formed at the two horizontal legs of the "Z".

According to another embodiment of the invention, the first fastening element is provided with a detent device which can retain the connection part in an assembled position. This eases the assembly because the unit consisting of the sliding bottom and the connection parts can be assembled with the side walls of a drawer or similar components. A simple construction of the detent devices is obtained if a detent device is integrally shaped to a pin and can engage into a recess of a side wall of the connection part.

The first fastening element therefore preferably comprises a pin which is swivellably disposed on the connection part and which can be inserted into the sliding bottom. This type of a fastening can be easily and rapidly mounted and can be produced at low cost by drilling a corresponding recess in the sliding bottom. A receiving of the pin, which is secure with respect to tilting, in the sliding bottom is ensured if a holding surface is molded to the pin on which holding surface the sliding bottom rests. In order to ensure a uniform support, the holding surface at the pin and the supporting surface on the connection part are arranged at the same level in the assembled condition.

The pin is preferably constructed as a hollow profile so that it maintains a certain elasticity and can also be fitted as a pressed connection into the sliding bottom.

A simple production of the fastening arrangement is permitted if each connection part has a section made of metal which reaches at least partially around a rail of the pull-out slide, and the first fastening element made of plastic material is molded onto the section made of metal. The spraying of plastic material around the connection part can be carried out in a simple manner in only one production step.

In the following, the invention will be explained in detail by means of an embodiment with respect to the attached drawings.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
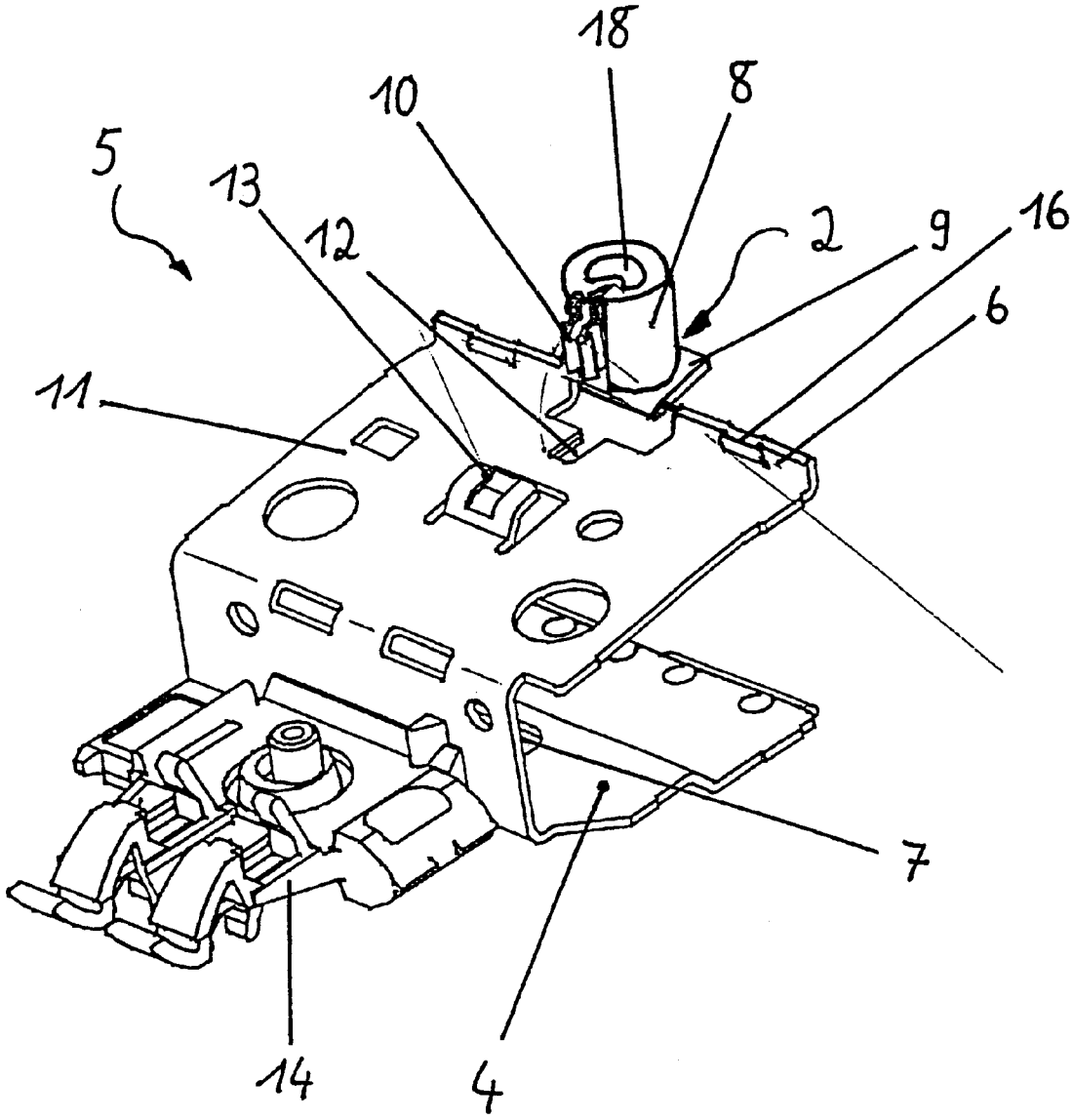
FIG. 1 is a perspective view of an embodiment of a connection part of a fastening arrangement according to the invention.
Figure 2:
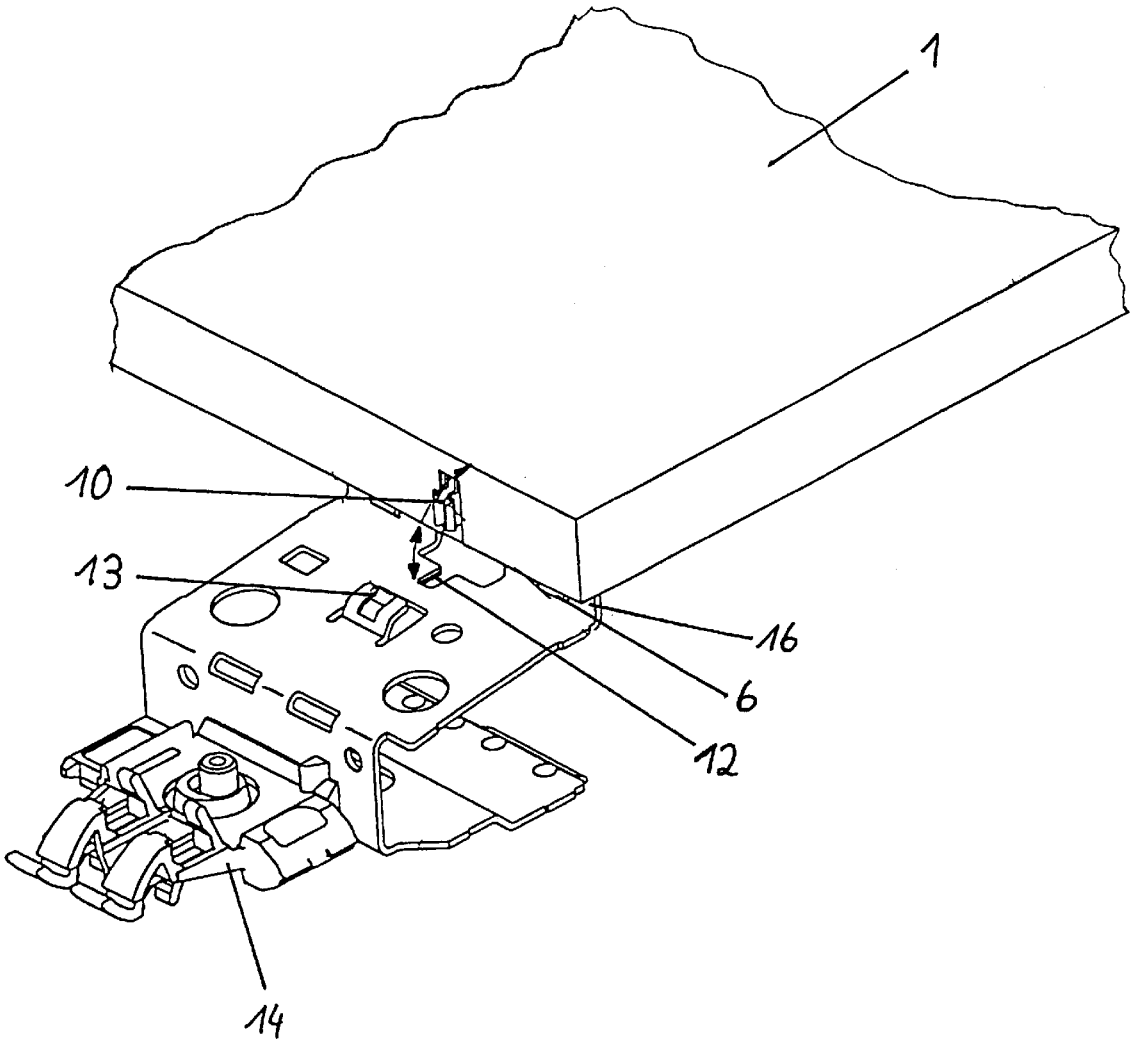
FIG. 2 is a perspective view of the connection part of FIG. 1 in connection with a sliding bottom in the preassembled condition.
Figure 3:
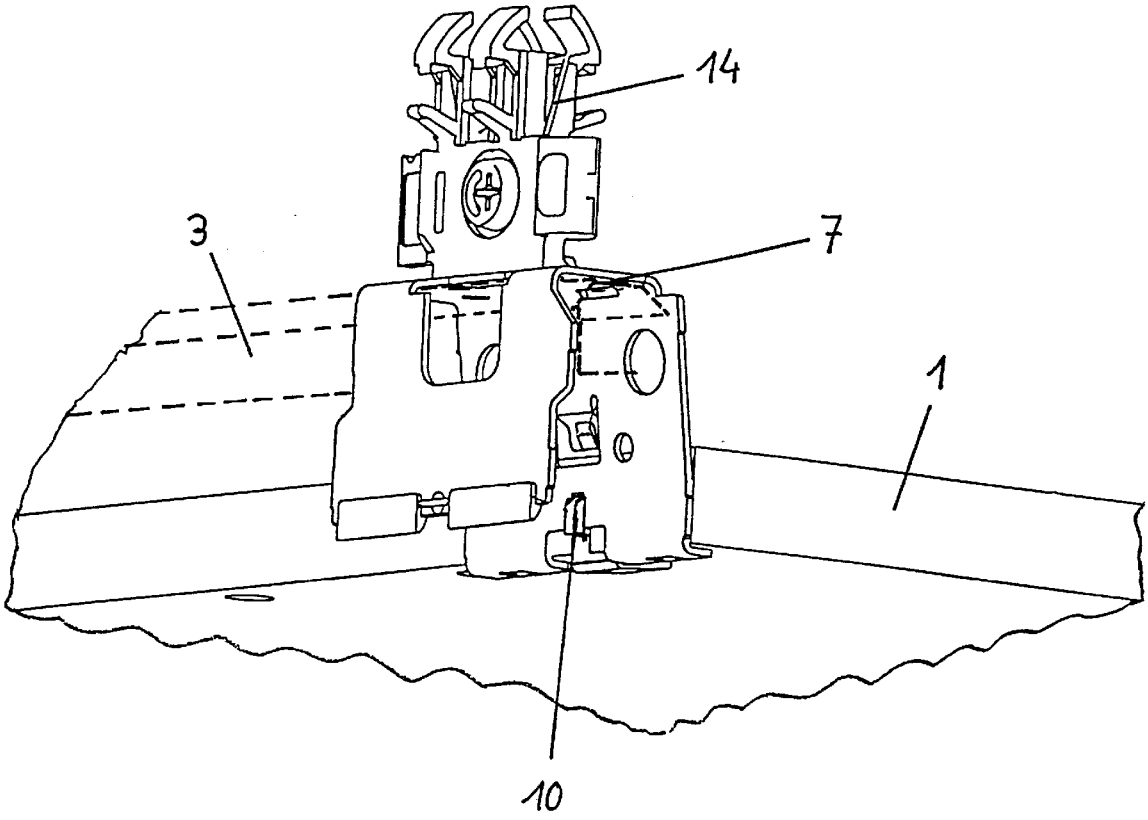
FIG. 3 is a perspective view of the connection part of FIG. 1 in a attached assembly position.

The fastening arrangement illustrated in FIGS. 1 to 3, using cutouts, has a connection part 5 which is provided with a first fastening element 2 which can be connected with a sliding bottom 1. The connection part 5 has a body made of metal which is provided with second fastening element 4 which fixedly connect a rail 3 of a pull-out slide with the connection part 5. The second fastening element 4 may be welded, riveted, screwed, glued or detent connections. In the illustrated embodiment, riveted connections 4, which are not shown in detail, are provided as second fastening element in order to fixedly connect the connection part 5 with the rail 3.

In order to remove the weight force of the sliding bottom 1 onto the pull-out slide, the connection element 5 is provided with a supporting surface 6, on which a lateral edge of the sliding bottom 1 can rest. In the illustrated embodiment, profilings 16 are additionally provided which precisely define the level of the supporting surface. In addition, the connection part 5 has a supporting surface 7 which rests on a horizontal surface of the rail 3 of the pull-out slide. The supporting surface 6 is connected with the supporting surface 7 by way of a side wall 11.

For fastening the connection element 5 to the sliding bottom 1, a pin 8 is provided which engages an opening in the sliding bottom 1. In this case, a holding surface 9 constructed integrally with the pin 8 forms a stop so that the sliding bottom 1 accommodates the pin 8 only to a certain depth (FIG. 2). For a uniform distribution of force, the holding surface 9 and the upper surface of the profilings 16 are arranged at the same level when the surfaces are aligned in parallel. It is also possible to align the supporting surface 6 with the level of the holding surface 9 and thus eliminate the profilings 16.

A detent device 10 arranged at the pin 8 reaches such through a lateral slot in the sliding bottom 1 that two elastic catches protrude beyond the lateral edge of the sliding bottom 1. The detent device 10 with the catches can be inserted into a recess 12 in the side wall 11 of the connection part 5 so that, after an engagement of the detent device 10, the connection part 5 is held in a mounting position.

On the side wall 11, the connection part 5 is provided with a shaped-out device 13 which can be used for fastening a side wall of a drawer. It is also possible to use the shaped-out device 13 as a stop against the sliding bottom 1. In addition, the connection part 5 is provided with an attachment 14 which is used for fastening additional components and can engage, for example, in a hollow side wall.

The mounting operation of the fastening arrangement will be described in the following:

After openings were made in the sliding bottom 1, the pin 8 of a connection part 5 is in each case inserted into an opening until the underside of the sliding bottom 1 rests on the holding surface 9. For a good hold of the sliding bottom 1, the pin 8 can be provided with grooves on the circumference. Furthermore, as a result of the hollow space 18, the pin 8 may have a slightly elastic construction in order to be inserted into the sliding bottom by means of a press fit.

The sliding bottom 1 is provided along two opposite sides with at least two connection parts 5 respectively. The connection parts 5 are first arranged so that the side walls 11 are parallel to the sliding bottom 1, such that the unit consisting of the sliding bottom 1 and the connection parts 5 can be transported without requiring a lot of space.

For the final assembly, the connection parts 5 are each folded up until the detent device 10 in each case snaps into the recess 12 so that the connection parts 5 are retained in a mounting position. Subsequently, a rail 3 of a pull-out slide will be fixedly connected with the connection parts 5 along a side of the sliding bottom 1. It is also possible to connect the rail 3 with the connection parts 5 before the fastening of the connection parts 5 on the sliding bottom 1. Finally, the remaining components, such as the side walls, the front walls and the rear walls, can be mounted on the fastening arrangement.

Figure 4:
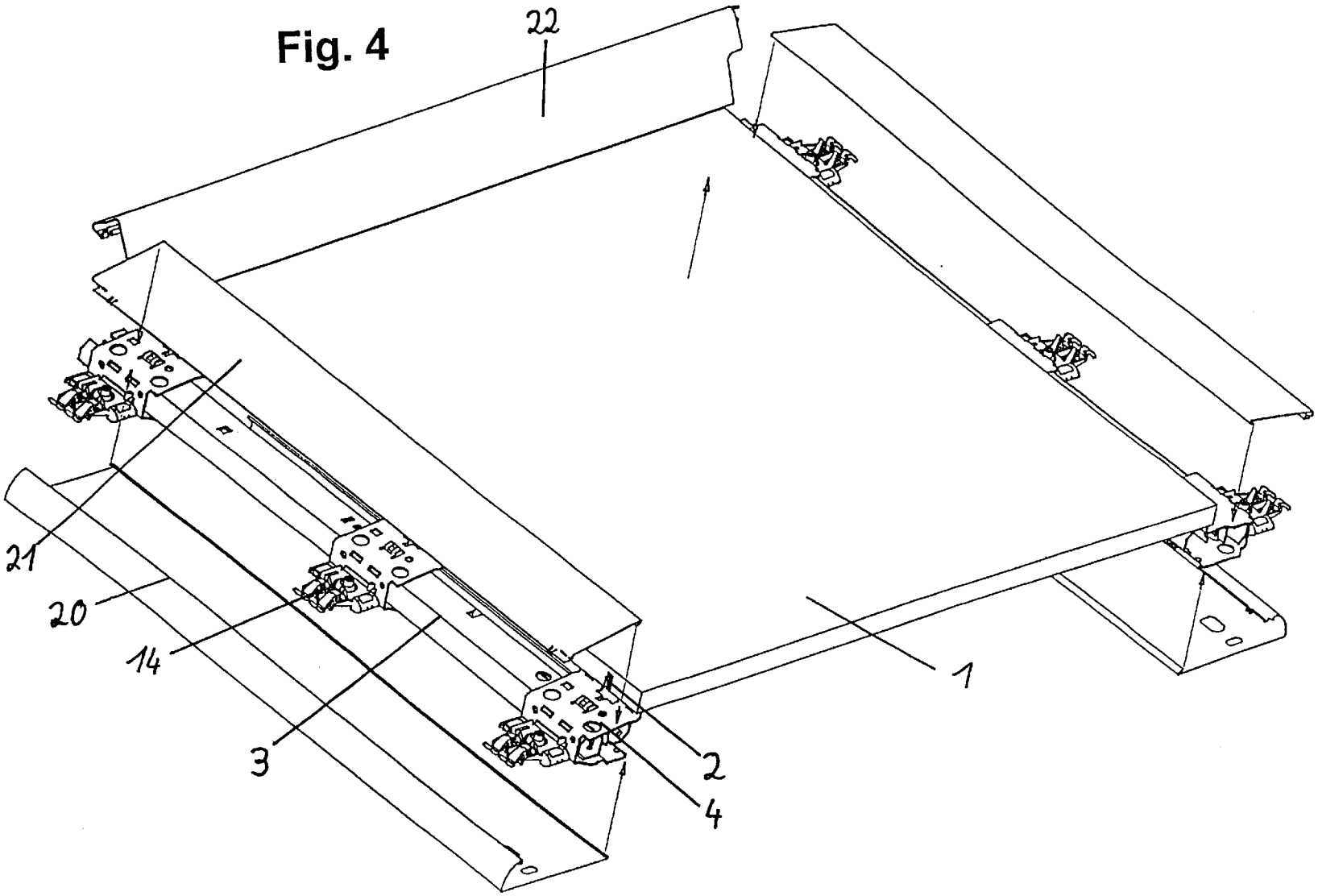
FIG. 4 is a perspective view of the fastening arrangement in the mounted condition.

FIG. 4 shows the fastening arrangement according to the invention in the mounted condition. Along a rail 3 of the pull-out slide, three fastening element 4 are arranged which are still folded parallel to the sliding bottom 1. An outer side wall element 20 and an inner side wall element 21 can be mounted on the attachments 14 of the fastening element 4. In order to produce a complete drawer from the fastening arrangement, a rear wall 22 which can be folded upward is provided on the rear side.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A fastening arrangement for fastening a drawer or a sliding bottom on a pull-out slide, comprising:

a plurality of connection parts for connection to a rail on one side of a drawer or sliding bottom and a plurality of connection parts for connection to a rail on the opposite side, each connection part having a first fastening element connectable with a hole in a first wall of a sliding bottom and having a detent device adapted to extend through a second wall of the sliding bottom;

a second fastening element connectable with a rail of the pull-out slide;

each first fastening element being pivotally connected to its respective second fastening element so that the detent engages a wall portion of the connection part to retain the connection part in the mounting position.

2. A fastening arrangement according to claim 1, wherein each first fastening element has a pin pivotally connected to the connection part and configured to be inserted into the sliding bottom.

3. A fastening arrangement according to claim 1, wherein each first fastening element has a holding surface with a pin molded thereto for supporting at least a portion of the sliding bottom.

4. A fastening arrangement according to claim 3, wherein the holding surface on the pin and a first supporting surface for supporting at least a portion of a sliding bottom, when aligned in parallel, are at the same level.

5. A fastening arrangement according to claim 4 wherein the pin pivots on an axis approximately level with the first supporting surface.

6. A fastening arrangement according to claim 4, wherein the pin is hollow.

7. A fastening arrangement for fastening a drawer or a sliding bottom on a pull-out slide, comprising a plurality of connection parts for connection to a rail on one side of a drawer or sliding bottom and a plurality of connection parts for connection to a rail on the opposite side, each connection part being shaped to extend only along a minor portion of a rail of the pull-out slide and having a first fastening element connectable with a sliding bottom, a second fastening element having an attachment for connecting with a wall element and connectable with a rail of the pull-out slide, and each first fastening element has a pin configured to be inserted into the sliding bottom and a detent device on the pin configured to catch a recess portion of the second fastening element for holding the connection part in a mounting position, whereby a plurality of fastening elements may be connected to a rail of a pull out slide for fastening a drawer or a sliding bottom on the pull-out slide.

8. A fastening arrangement according to claim 7, wherein each connection part has a first supporting surface for supporting at least a portion of a sliding bottom, and a second supporting surface capable of resting on a rail of the pull-out slide.

9. A fastening arrangement according to claim 7, further comprising a detent device on each first fastening element, the detent device configured to engage the connection part in a mounting position.

10. A fastening arrangement according to claim 9 further comprising a side wall connecting a first supporting surface for supporting at least a portion of a sliding bottom and a second supporting surface capable of resting on rail of the pull-out slide and having a recess which interacts with the detent device.

11. A fastening arrangement according to claim 7, wherein each connection part has a section made of metal which at least partially reaches around a rail of the pull-out slide, and at least the first fastening element is made of a plastic material is molded to the section made of metal.

* * * * *